US009899756B2

(12) United States Patent
Ootani

(10) Patent No.: US 9,899,756 B2
(45) Date of Patent: Feb. 20, 2018

(54) CONNECTOR AND CONNECTOR STRUCTURE

(71) Applicant: JAPAN AVIATION ELECTRONICS INDUSTRY, LIMITED, Tokyo (JP)

(72) Inventor: Hideyuki Ootani, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/399,934

(22) Filed: Jan. 6, 2017

(65) Prior Publication Data

US 2017/0264035 A1 Sep. 14, 2017

(30) Foreign Application Priority Data

Mar. 9, 2016 (JP) ..... 2016-045551

(51) Int. Cl.
*H01R 12/72* (2011.01)
*H01R 24/58* (2011.01)
*H01R 12/71* (2011.01)

(52) U.S. Cl.
CPC ..... *H01R 12/721* (2013.01); *H01R 24/58* (2013.01); *H01R 12/714* (2013.01); *H01R 12/722* (2013.01)

(58) Field of Classification Search
CPC .... H01R 12/721; H01R 24/58; H01R 12/714; H01R 12/722
USPC ..... 439/59.668
See application file for complete search history.

(56) References Cited

U.S. PATENT DOCUMENTS 3,514,737 A * 5/1970 Renshaw, Jr. ..... H01R 9/0515 439/63
4,647,136 A * 3/1987 Kinoshita ..... H01R 12/722 439/571
5,092,795 A * 3/1992 Kitagawa ..... H01R 24/58 439/668
6,869,315 B2 * 3/2005 Nakai ..... H01R 24/40 439/668

(Continued)

FOREIGN PATENT DOCUMENTS

CN 203826667 U 9/2014
CN 204144492 U 2/2015

(Continued)

OTHER PUBLICATIONS

European Search Report in EP 17155891.9 dated Jun. 7, 2017.

*Primary Examiner* — Alexander Gilman
(74) *Attorney, Agent, or Firm* — Collard & Roe, P.C.

(57) ABSTRACT

A connector is attachable to a board having a principal surface, a recess and a board-side contact portion. When the connector is attached to the board, the connector is, at least in part, arranged within the recess while an upper-lower direction with respect to the connector intersects with the principal surface. The connector comprises a contact and a holding member having a protection portion. The contact has a held portion held by the holding member, a support portion extending from the held portion to be resiliently deformable and a contact portion supported by the support portion. When the connector is attached to the board, the contact portion is brought into contact with the board-side contact portion, and the protection portion is, at least in part, positioned within the recess. The protection portion hides the contact portion when seen along a first horizontal direction perpendicular to the upper-lower direction.

13 Claims, 13 Drawing Sheets

(56) References Cited

U.S. PATENT DOCUMENTS

| | | | | |
|---|---|---|---|---|
| 7,238,059 | B1 | 7/2007 | Wu | |
| 7,534,146 | B2 * | 5/2009 | Chien | H01R 24/58 439/668 |
| 9,113,252 | B2 * | 8/2015 | Liu | H01R 24/58 |
| 9,343,856 | B2 * | 5/2016 | Zwartkruis | H01R 13/5202 |
| 9,362,639 | B2 * | 6/2016 | Zhang | H01R 12/72 |
| 9,520,685 | B2 * | 12/2016 | Zhao | H01R 12/721 |
| 2006/0148314 | A1 * | 7/2006 | Castaneda | H01R 12/57 439/581 |
| 2007/0127764 | A1 * | 6/2007 | Yang | H01R 13/415 381/384 |
| 2008/0268703 | A1 | 10/2008 | Chien et al. | |
| 2009/0149080 | A1 * | 6/2009 | Wu | H01R 12/57 439/668 |
| 2010/0055989 | A1 * | 3/2010 | Su | H01R 24/58 439/675 |
| 2010/0203767 | A1 * | 8/2010 | Zhang | H01R 24/58 439/660 |
| 2011/0104956 | A1 * | 5/2011 | Guo | H01R 12/57 439/668 |
| 2016/0056591 | A1 | 2/2016 | Zhao et al. | |

FOREIGN PATENT DOCUMENTS

| | | | |
|---|---|---|---|
| JP | H06-36255 | U | 5/1994 |
| JP | H09-22761 | A | 1/1997 |
| JP | 2002-117948 | A | 4/2002 |
| JP | 2003-308933 | A | 10/2003 |
| KR | 101499060 | B1 | 3/2015 |

* cited by examiner

CONNECTOR AND CONNECTOR STRUCTURE

CROSS REFERENCE TO RELATED APPLICATIONS

This application is based on and claims priority under 35 U.S.C. § 119 to Japanese Patent Application No. JP2016-045551 filed Mar. 9, 2016, the contents of which are incorporated herein in their entirety by reference.

BACKGROUND OF THE INVENTION

This invention relates to a connector and, in particular, relates to a connector partially accommodated in a recess of a board.

For example, a connector partially accommodated in a recess of a board is disclosed in CN 204144492U (Patent Document 1), the content of which is incorporated herein by reference. Referring to FIG. 25, Patent Document 1 discloses a connector 900 which is attached to a board 950 to form a connector structure 90.

As can be seen from FIG. 25, the board 950 has a recess 955 which partially accommodates the connector therewithin. The recess 955 is recessed in a direction perpendicular to an upper-lower direction (Z-direction). The board 950 has an inner edge portion that defines the recess 955. The inner edge portion is provided with board-side contact portions 957.

As shown in FIGS. 25 and 26, the connector 900 comprises a plurality of contacts 910 and a housing (holding member) 930 which holds the contacts 910. Each of the contacts 910 has a support portion 911, which is resiliently deformable, and a contact portion 913 held by the support portion 911. The contact portion 913 is exposed outward from a side surface 931 of the housing 930. The support portion 911 is, at least in part, accommodated in an indention 933 formed in the housing 930. In particular, an end 915 of the support portion 911 is accommodated within the indention 933.

As can be seen from FIG. 25, the connector 900 is moved into the recess 955 of the board 950 along the upper-lower direction to be partially arranged in the recess 955. Under a state where the connector 900 is attached to the board 950, the connector 900 partially projects upward, or in the positive Z-direction, from a principal surface (upper surface) 951 of the board 950 and partially projects downward, or in the negative Z-direction, from another principal surface (lower surface) 953 of the board 950. The board-side contact portions 957 correspond to the contact portions 913 of the connector 900, respectively. Under the state where the connector 900 is attached to the board 950, each of the contact portions 913 of the connector 900 is electrically connected to the corresponding board-side contact portion 957.

According to the connector 900 of Patent Document 1, the end 915 of the support portion 911 of the contact 910 is accommodated within the indention 933 of the housing 930. This accommodation prevents the end 915 of the support portion 911 from being brought into abutment with the board 950 upon the movement of the connector 900 into the recess 955 of the board 950. Moreover, even if the contact portion 913 of the contact 910 receives a force along a direction perpendicular to the upper-lower direction, the movement of the support portion 911 is restricted. Therefore, according to the connector 900 of Patent Document 1, the contact 910 is prevented from being buckled. However, according to the structure of the connector 900 of Patent Document 1, the end 915 of the support portion 911 of the contact 910 is required to be accommodated within the indention 933 of the housing 930 while the contact portion 913 of the contact 910 is exposed outward from the side surface 931 of the housing 930. This requirement limits the flexibility of design of the contact 910.

SUMMARY OF THE INVENTION

It is therefore an object of the present invention to provide a connector having a structure which is different from that of Patent Document 1 but can prevent a contact from being buckled or damaged.

An aspect of the present invention provides a connector attachable to a board having a principal surface, a recess and a board-side contact portion. When the connector is attached to the board, the connector is, at least in part, arranged within the recess while an upper-lower direction with respect to the connector intersects with the principal surface. The connector comprises at least one contact and a holding member which holds the contact. The contact has a held portion held by the holding member, a support portion extending from the held portion to be resiliently deformable and a contact portion supported by the support portion. When the connector is attached to the board, the contact portion is brought into contact with the board-side contact portion. The holding member has at least one protection portion which protects the contact. When the connector is attached to the board, the protection portion is, at least in part, positioned within the recess. The protection portion hides the contact portion when seen along a first horizontal direction perpendicular to the upper-lower direction.

Another aspect of the present invention provides a connector comprising a plurality of contacts and a holding member which holds the contacts. The contacts are arranged along a predetermined direction. Each of the contacts has a held portion held by the holding member, a support portion extending from the held portion to be resiliently deformable and a contact portion supported by the support portion. The holding member has at least one protection portion which protects the contact. The protection portion hides the contact portion when seen along the predetermined direction.

Still another aspect of the present invention provides a connector structure comprising the connector and the board.

When the connector according to an aspect of the present invention is seen along the first horizontal direction, the protection portion hides the contact portion of the contact. Thus, the protection portion protects the contact. This structure prevents or reduces an undesirable force which might be applied to the contact portion by the board when the connector is attached to the board, so that the contact can be prevented from being buckled or damaged.

An appreciation of the objectives of the present invention and a more complete understanding of its structure may be had by studying the following description of the preferred embodiment and by referring to the accompanying drawings.

Figure 1:
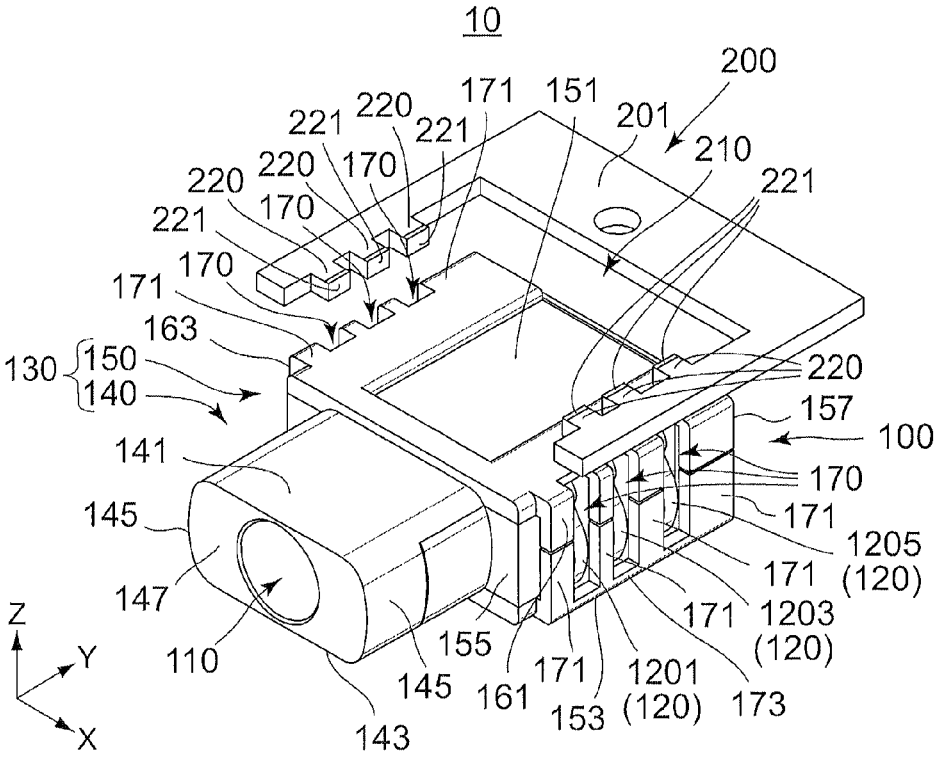
FIG. 1 is a perspective view showing a connector structure according to a first embodiment of the present invention, wherein a connector of the connector structure is not attached to a board of the connector structure.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
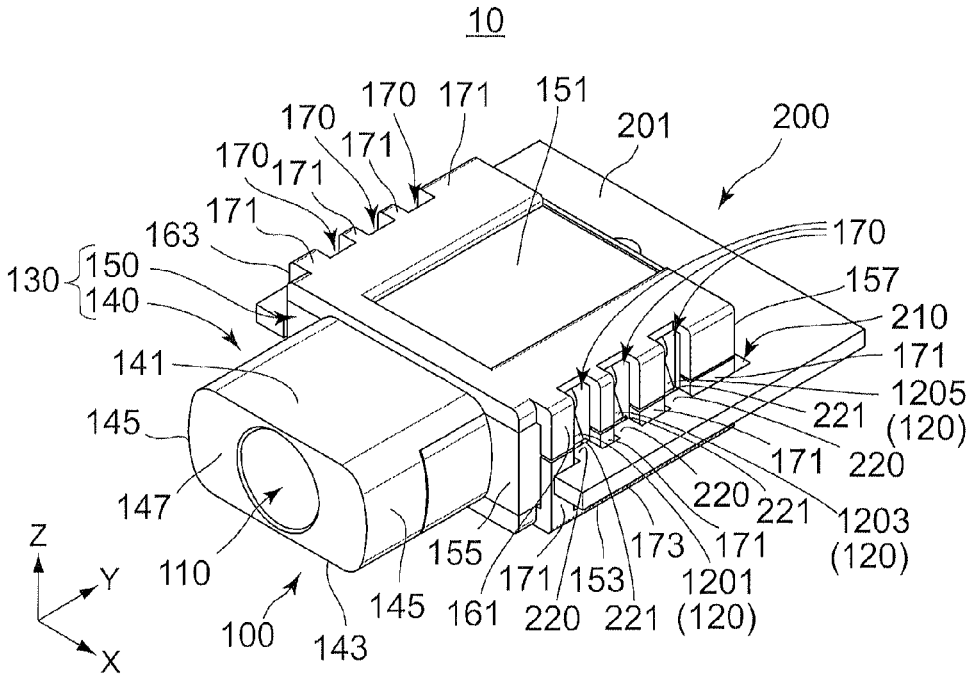
FIG. 2 is another perspective view showing the connector structure of FIG. 1, wherein the connector is attached to the board.
Figure 3:
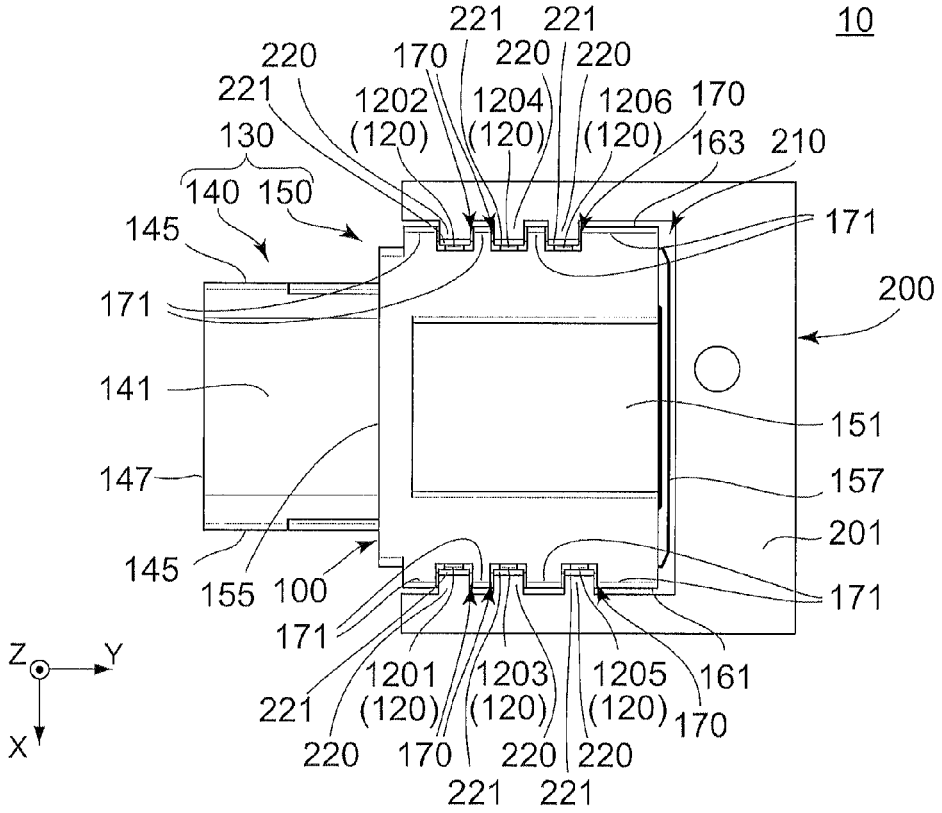
FIG. 3 is a plan view showing the connector structure of FIG. 2.
Figure 4:
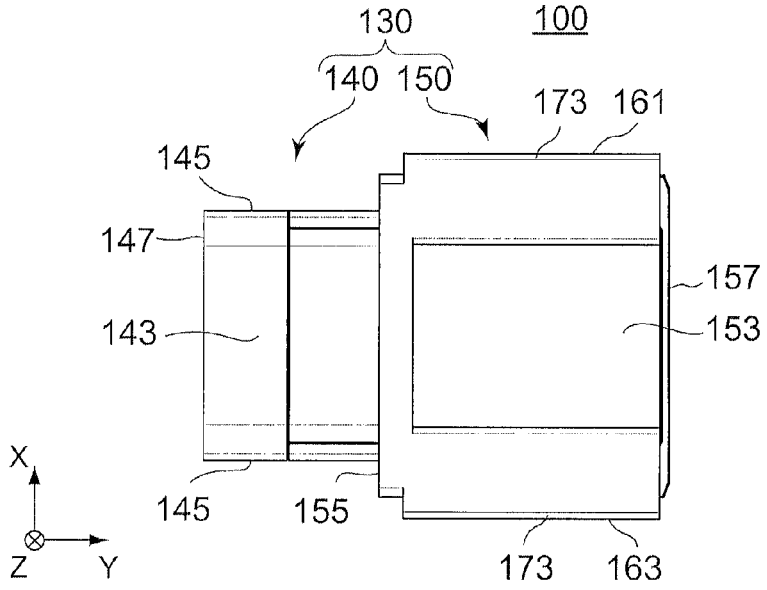
FIG. 4 is a bottom view showing the connector of the connector structure of FIG. 3.

Referring to FIGS. 1 to 3, a connector structure 10 according to a first embodiment of the present invention comprises a connector 100 and a board 200. In the present embodiment, the connector 100 is attached to the board 200 to form the connector structure 10.

As shown in FIGS. 1, 2 and 6 to 9, the connector 100 has an accommodation portion 110 which accommodates, at least in part, a mating connector (not shown) which is a plug. The accommodation portion 110 is a space which extends in a front-rear direction (Y-direction, first horizontal direction) perpendicular to an upper-lower direction (Z-direction). The accommodation portion 110 has a circular shape in a cross-section perpendicular to the front-rear direction.

As shown in FIGS. 1 to 3 and 5 to 9, the connector 100 comprises a plurality of contacts 120 (or 1201 to 1206) and a housing (holding member) 130 which holds the contacts 120. Each of the contacts 120 is made of conductive metal plate, and the housing 130 is made of insulating resin.

As can be seen from FIGS. 1 to 3 and 7, in the present embodiment, the number of the contacts 120 is six. Specifically, the connector 100 according to the present embodiment comprises the first to sixth contacts 1201 to 1206. However, the present invention is not limited thereto. The number of the contacts 120 can be variously designed in accordance with the number of mating contact portions of mating contact.

As can be seen from FIGS. 7 to 15, the first contact 1201 to the sixth contact 1206 have shapes different from one another. However, the present invention is not limited thereto. The shape of each of the contacts 120 (1201 to 1206) can be variously designed in accordance with various factors such as the shape of the mating contact and the shape of the housing 130. For example, a plurality of the contacts 120 may have shapes same as one another. As shown in FIGS. 10 to 15, each of the first contact 1201 to the sixth contact 1206, regardless of its shape, has a held portion 121, a first support portion (support portion) 123, a second support portion 125, a first contact portion (contact portion) 127 and a second contact portion (additional contact portion) 129. The held portion 121 is held by the housing 130. The first support portion 123 extends from the held portion 121 to be resiliently deformable. The first contact portion 127 is held by the first support portion 123 and is movable at least in a left-right direction (X-direction, second horizontal direction) because of the resilient deformation of the first support portion 123. In the present embodiment, the left-right direction is a direction perpendicular to both the upper-lower direction and the front-rear direction. The second support portion 125 extends from the held portion 121 to be resiliently deformable like the first support portion 123. The second contact portion 129 is held by the second support portion 125 and is movable at least in a predetermined direction perpendicular to the front-rear direction because of the resilient deformation of the second support portion 125. In the present embodiment, the predetermined direction of each of the first contact 1201 to the fifth contact 1205 is the left-right direction, while the predetermined direction of the sixth contact 1206 is a direction intersecting with both the upper-lower direction and the left-right direction. Each of the contacts 120 can be formed by punching out a metal plate and subsequently bending the metal plate.

Figure 5:
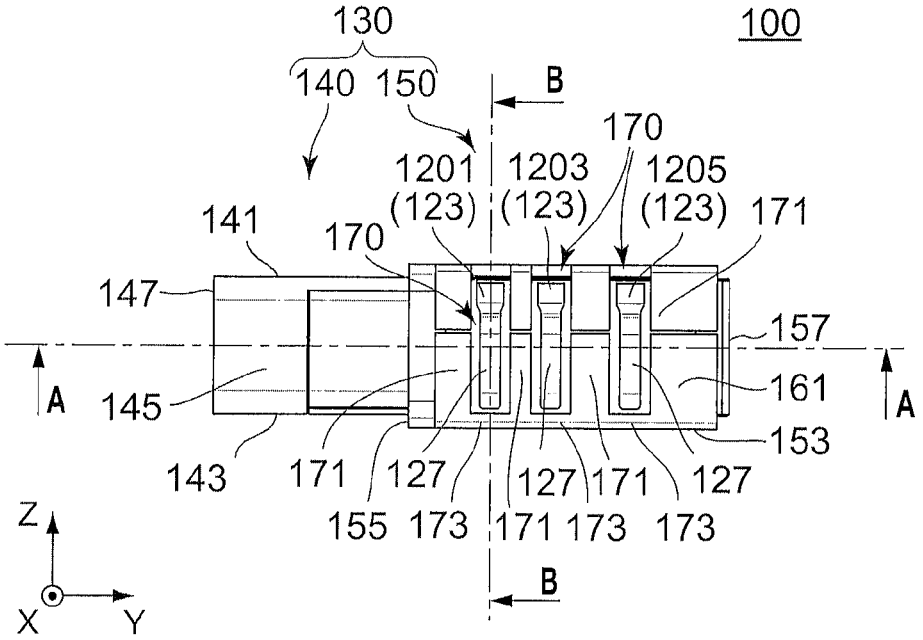
FIG. 5 is a right side view showing the connector of FIG. 4.
Figure 6:
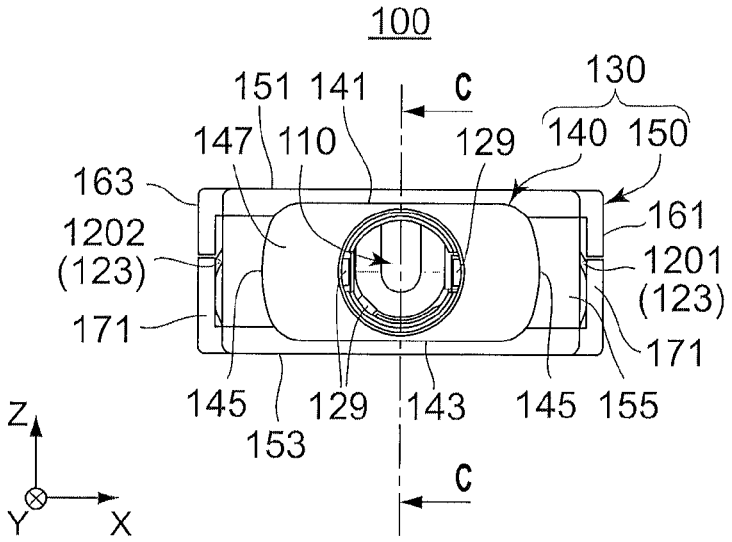
FIG. 6 is a front view showing the connector of FIG. 4.
Figure 7:
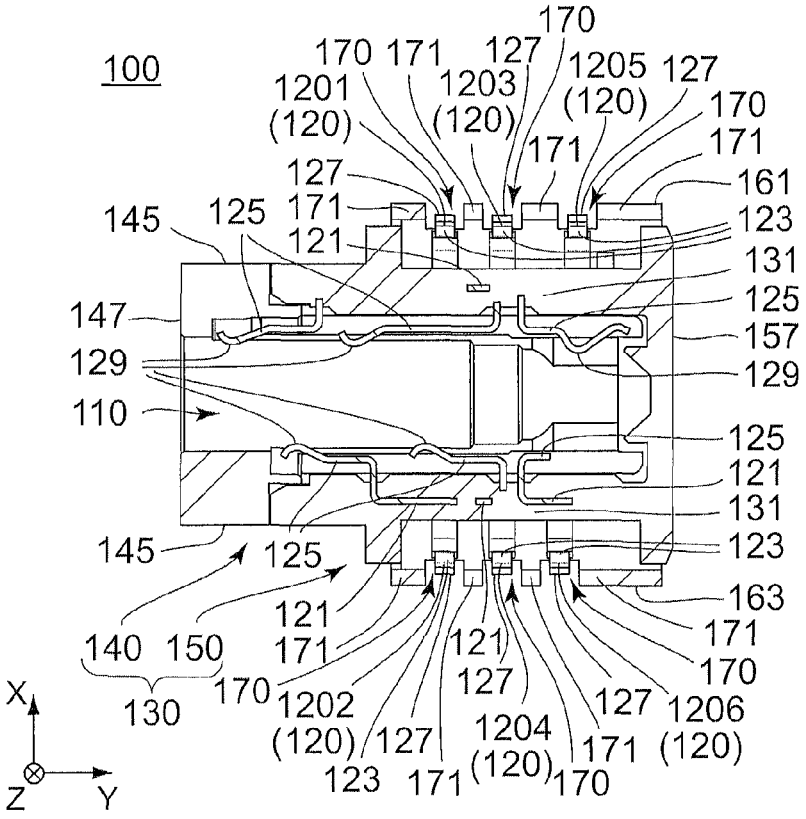
FIG. 7 is a cross-sectional view showing the connector of FIG. 5, taken along line A-A.

As shown in FIGS. 1 to 7 and 9, the housing 130 has a front portion 140 and a rear portion 150 which continuously extend in the front-rear direction. The rear portion 150 has a rectangular parallelepiped shape. In detail, the rear portion 150 has an upper surface 151, a lower surface 153, a front surface 155, a rear surface 157 and a pair of side surfaces 161 and 163. The upper surface 151 and the lower surface 153 are apart from each other in the upper-lower direction. The front surface 155 and the rear surface 157 are apart from each other in the front-rear direction. The side surfaces 161 and 163 are apart from each other in the left-right direction. The front portion 140 projects forward, or in the negative Y-direction, from the front surface 155 of the rear portion 150. The front portion 140 has an upper surface 141, a lower surface 143, a pair of side surfaces 145 and a front surface 147. Each of the upper surface 141 and the lower surface 143 is a flat plane. Each of the side surfaces 145 is bent outward. The housing 130 has the accommodation portion 110. In detail, the accommodation portion 110 is formed within the housing 130 and opens at the front surface 147 of the front portion 140. As shown in FIG. 7, the accommodation portion 110 extends to the vicinity of the rear surface 157 of the rear portion 150 in the front-rear direction.

As shown in FIGS. 1 to 3, 5, 7 and 8, each of the side surfaces 161 and 163 of the housing 130 is formed with a plurality of side recesses 170. Each of the side recesses 170 is recessed inward in the left-right direction from one of the side surfaces 161 and 163 toward the inside of the housing 130. As shown in FIG. 3, each of the side recesses 170 is a recess which has a rectangular shape when seen along the upper-lower direction. As shown in FIGS. 1, 2 and 5, each of the side recesses 170 is surrounded on its three sides by two vertical walls (protection portions) 171 and one lateral wall (additional protection portion) 173. In other words, each of the side recesses 170 is formed by the two vertical walls 171 and the one lateral wall 173. Each of the two vertical walls 171 extends in the upper-lower direction. The two vertical walls 171 are apart from each other in the front-rear direction. The lateral wall 173 extends in the front-rear direction. The lateral wall 173 couples ends of the vertical walls 171 to each other. As can be seen from FIGS. 1 to 3, 5 and 7, in the present embodiment, the side recesses 170 correspond to the contacts 120, respectively. Therefore, the side surface 161 is formed with three of the side recesses 170, and the other side surface 163 is formed with remaining three of the side recesses 170. However, the present invention is not limited thereto. The number and the arrangement of the side recesses 170 can be variously designed in accordance with the number and the arrangement of the contacts 120.

Figure 8:
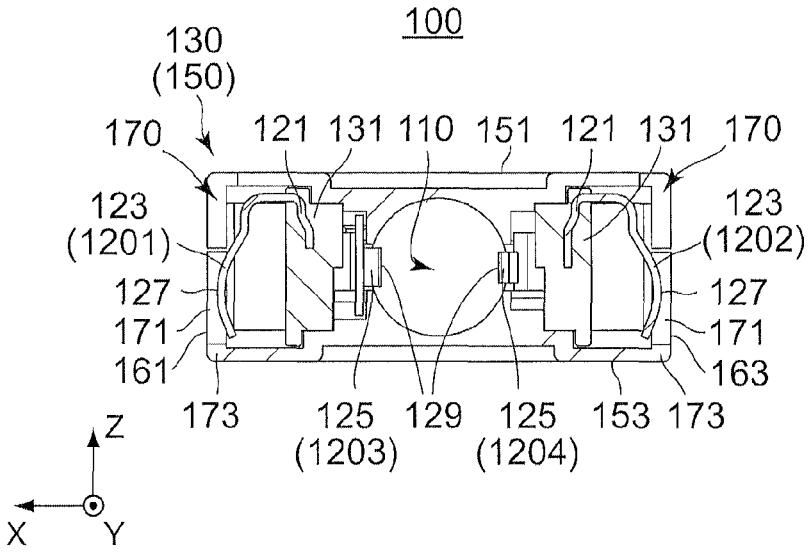
FIG. 8 is a cross-sectional view showing the connector of FIG. 5, taken along line B-B.
Figure 9:
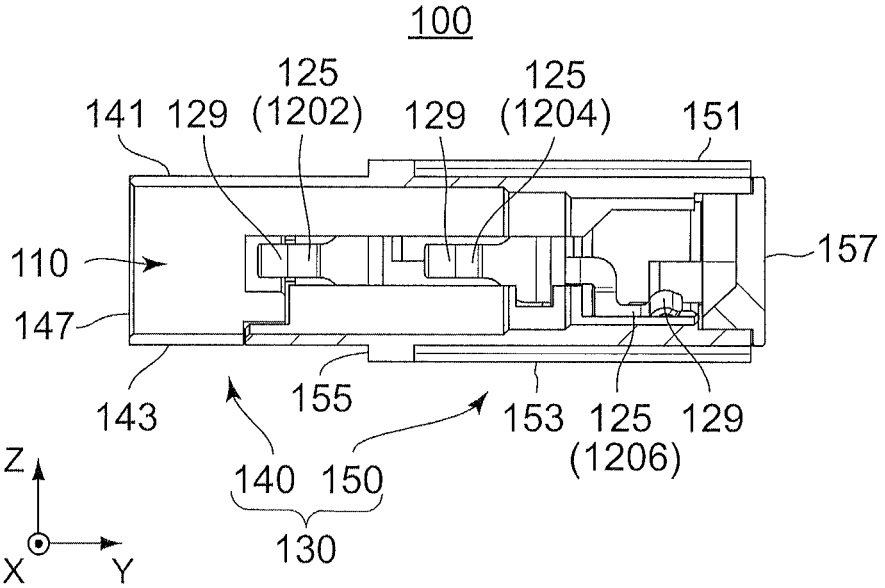
FIG. 9 is a cross-sectional view showing the connector of FIG. 6, taken along line C-C.
Figure 10:
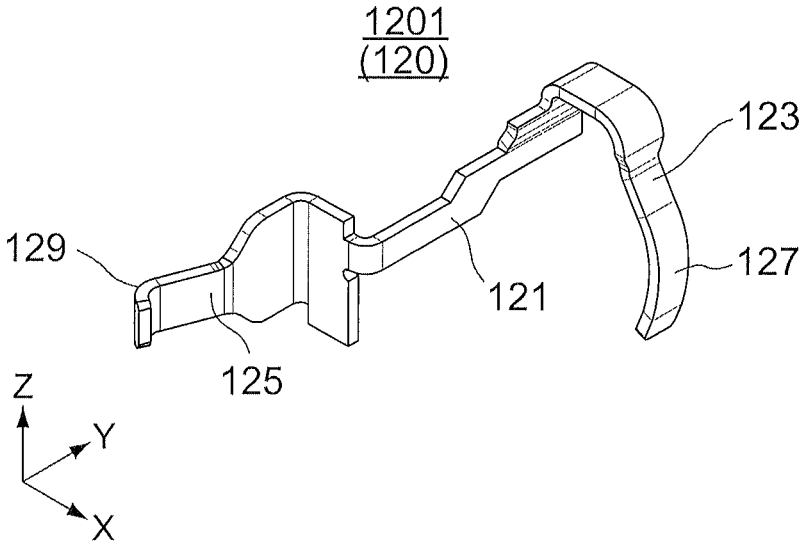
FIG. 10 is a perspective view showing a first contact of the connector of FIG. 7.
Figure 11:
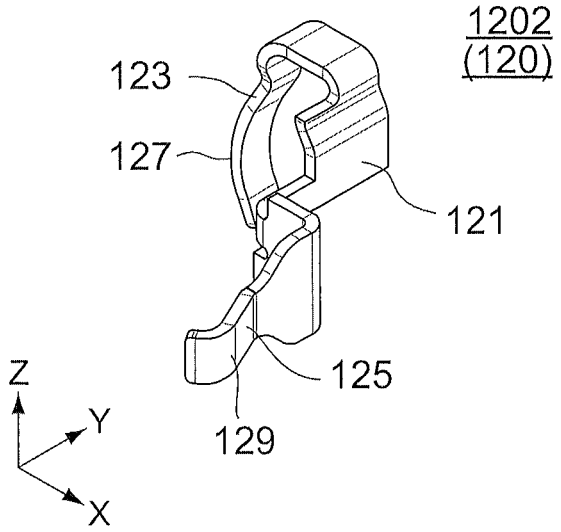
FIG. 11 is a perspective view showing a second contact of the connector of FIG. 7.
Figure 12:
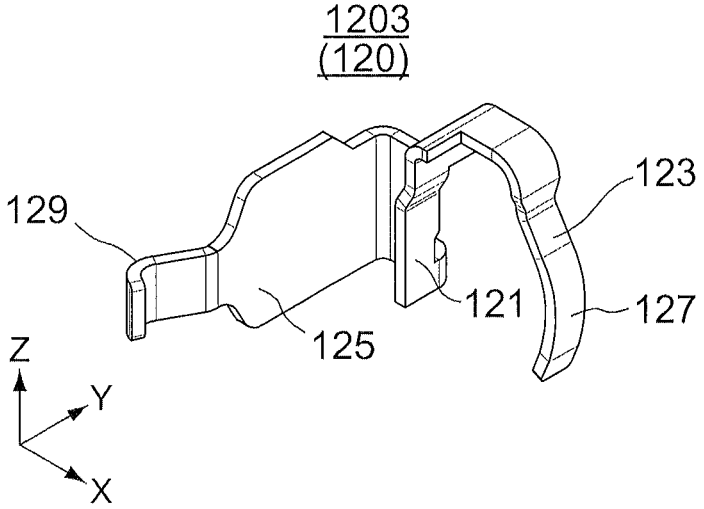
FIG. 12 is a perspective view showing a third contact of the connector of FIG. 7.
Figure 13:
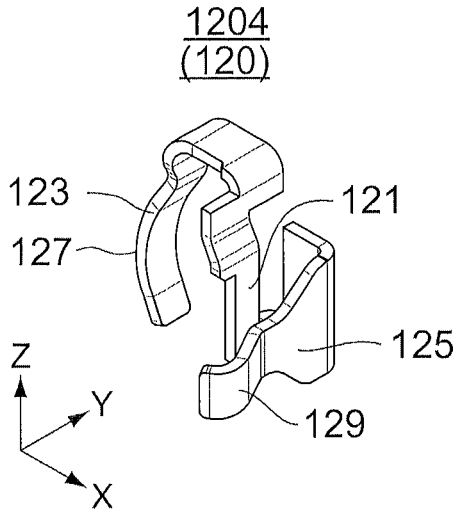
FIG. 13 is a perspective view showing a fourth contact of the connector of FIG. 7.
Figure 14:
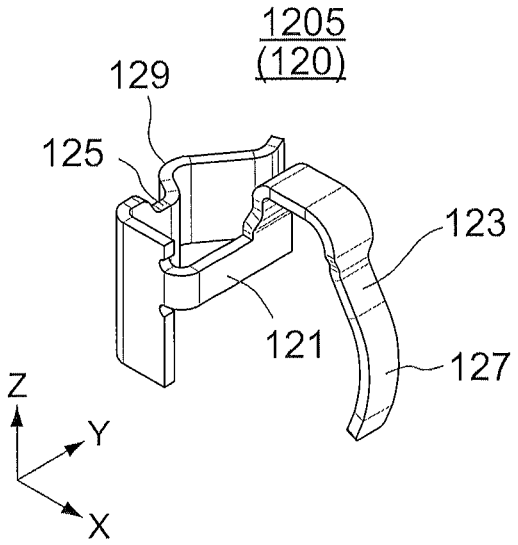
FIG. 14 is a perspective view showing a fifth contact of the connector of FIG. 7.
Figure 15:
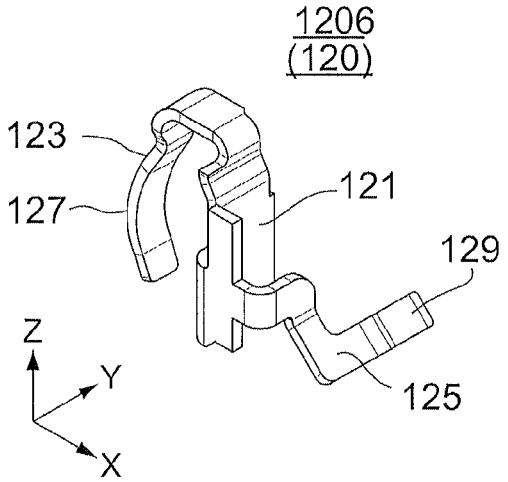
FIG. 15 is a perspective view showing a sixth contact of the connector of FIG. 7.

As can be seen from FIGS. 7 to 9, the housing 130 has two holding portions 131 each of which holds the held portions 121 of three of the contacts 120. In other words, the holding portions 131 of the housing 130 hold the held portion 121 of each of the contacts 120. The first contact portions 127 of the thus-held contacts 120 are arranged in two rows each of which extends along the front-rear direction. The first contact portion 127 of each of the contacts 120 is positioned within the corresponding side recess 170 and faces outward in the left-right direction. Moreover, the first support portion 123, which supports the first contact portion 127, is partially positioned within the corresponding side recess 170. Each of the second contact portions 129 projects in the accommodation portion 110. The second support portion 125, which supports the second contact portion 129, is partially positioned within the accommodation portion 110. The housing 130 may be formed integrally with the contacts 120 via integral molding.

As can be seen from FIG. 5, three of the contacts 120 are positioned at the side surface 161, and the first contact portions 127 thereof are arranged in the front-rear direction (pitch direction). Remaining three of the contacts 120 are positioned at the other side surface 163, and the first contact portions 127 thereof are arranged in the front-rear direction (pitch direction). In the present embodiment, each of the first contact portions 127 is apart from the nearest vertical wall 171 by a distance which is shorter than the minimum one of distances each of which is a distance between the two first contact portions 127 adjacent to each other.

As can be seen from FIGS. 6 to 8, under a state where no load is applied to the contact 120, the vertical wall 171 hides the first contact portion 127 and hides, at least in part, the first support portion 123 when seen along the front-rear direction. Moreover, as can be seen from FIG. 4, the lateral wall 173 hides the first contact portion 127 and the first support portion 123 when seen along the upper-lower direction. In other words, the first contact portion 127 of each of the contacts 120 is positioned within the corresponding side recess 170 and does not project outward beyond the side surface 161 or 163 in the left-right direction. Therefore, at least a part of each of the vertical walls 171 works as a protection portion that protects the corresponding first contact portion 127, and at least a part of each of the lateral walls 173 works as an additional protection portion that protects the corresponding first contact portion 127. As described above, in the present embodiment, the housing 130 has the protection portions and the additional protection portions each of which protects the corresponding first contact portion 127. Moreover, in the present embodiment, each of the vertical walls 171 has two parts which are apart from each other in the upper-lower direction so that a gap is formed therebetween. According to the present embodiment, when each of the vertical walls 171 is seen along the front-rear direction, none of the first support portion 123 and the first contact portion 127 is visible through the gap between the two parts thereof. However, a part of each of the first support portion 123 and the first contact portion 127 may be visible through the gap between the two parts of each of the vertical walls 171. Moreover, the two parts of each of the vertical walls 171 may be formed into a single part with no gap. As shown in FIGS. 7 and 8, each of the vertical walls 171 is separated from the corresponding holding portion 131, which holds the corresponding contact 120, in the left-right direction. However, each of the vertical walls 171 may be continued to the corresponding holding portion 131.

As shown in FIGS. 1 to 3, the board 200 has a principal surface 201 and a recess 210 which accommodates, at least in part, the connector 100. The recess 210 has a size which is so large as to accommodate a corresponding part of the housing 130 of the connector 100. In addition, the board 200 has a plurality of projecting portions 220. According to the present embodiment, each of the projecting portions 220 projects inward in the left-right direction within the recess 210. However, each of the projecting portions 220 may project in a direction which is perpendicular to the upper-lower direction and intersects with the first horizontal direction. The projecting portions 220 correspond to the side recesses 170 of the connector 100, respectively. Each of the projecting portions 220 has a rectangular shape when seen along the upper-lower direction and is smaller than the corresponding side recess 170 in the front-rear direction. Each of the projecting portions 220 has an end which is provided with a board-side contact portion 221. Thus, the board 200 has a plurality of the board-side contact portions 221 which are formed on the projecting portions 220, respectively. The board-side contact portions 221 correspond to the contacts 120 of the connector 100, respectively. When the connector 100 is attached to the board 200, the first contact portions 127 of the connector 100 are brought into contact and electrically connected with the board-side contact portions 221, respectively. In the present embodiment, each of the first contact portions 127 is brought into contact with the corresponding board-side contact portion 221 in the left-right direction. However, each of the first contact portions 127 may be brought into contact with the corresponding board-side contact portion 221 in a direction which is perpendicular to the upper-lower direction and intersects with the front-rear direction.

As can be seen from FIGS. 2 and 3, the connector 100 is, at least in part, arranged within the recess 210 of the board 200 when attached to the board 200. According to the present embodiment, the recess 210 of the board 200 partially accommodates the rear portion 150 of the connector 100. According to the present embodiment, the recess 210 is recessed in a direction in parallel to the principal surface 201 of the board 200, or in the positive Y-direction, and opens in another direction in parallel to the principal surface 201 of the board 200, or in the negative Y-direction. However, the present invention is not limited thereto. For example, the recess 210 may be closed in every direction in parallel to the principal surface 201 of the board 200. More specifically, the recess 210 may be a hole which is formed at a position apart from the edge of the board 200 so as to pass through the board 200 in a direction perpendicular to the principal surface 201 of the board 200, or in the upper-lower direction. Moreover, when the board 200 has a sufficient thickness, the recess 210 may be an indention which is formed on the board 200 to have a bottom. Moreover, although the board 200 of the present embodiment is assumed to be rigid, the board 200 may have flexibility.

As can be seen from FIGS. 1 and 2, when the connector 100 is attached to the board 200, the upper-lower direction with respect to the connector 100 intersects with, preferably perpendicular to, the principal surface 201 of the board 200. In detail, the connector 100 is first positioned under the board 200, or positioned toward the negative Z-side of the board 200, and subsequently moved upward, or moved in the positive Z-direction, so that the connector 100 is attached to the board 200. During this attachment process, the first contact portions 127 and the first support portions 123 of the connector 100 are protected by the protection portions, or by the vertical walls 171. In detail, in the attachment process of the connector 100 to the board 200, the vertical walls 171 are moved into the recess 210 of the board 200 at first, and subsequently the first contact portions 127 of the contacts 120 are brought into contact with the board-side contact portions 221, respectively. This process sequence prevents each of the contacts 120 from being buckled or damaged. Moreover, the vertical walls 171 are, at least in part, positioned within the recess 210 of the board 200 to prevent or restrict the movement of the connector 100 relative to the board 200 in the front-rear direction. Therefore, each of the contacts 120 receives no substantial force in the front-rear direction from the board 200. As a result, each of the contacts 120 is prevented from being buckled or damaged. In addition, the lateral walls 173 prevent the connector 100 from being attached to the board 200 under an upside-down state. Thus, the lateral walls 173 prevent the ends of the contacts 120 from being brought into contact with the board-side contact portions 221. As a result, each of the contacts 120 is further prevented from being buckled or damaged.

The mating connector (not shown) is a phone plug such as a terminal of a headphone and has the mating contact (not shown) of a cylindrical shape. The mating contact has a plurality of the mating contact portions (not shown) which are arranged in an axial direction and insulated from one another. Each of the mating contact portions is a part of a circumference surface of the mating contact. As can be seen from FIGS. 7 and 9, the second contact portions 129 of the contacts 120 are arranged at positions different from one another in the front-rear direction so as to correspond to the mating contact portions, respectively. As can be seen from FIGS. 6 to 9, each of the second contact portions 129 projects in the accommodation portion 110. When the mating contact is accommodated in the accommodation portion 110, each of the second contact portions 129 is brought into contact with the corresponding mating contact portion. As a result, each of the second contact portions 129 is electrically connected with the corresponding mating contact portion.

Second Embodiment

Referring to FIGS. 16 to 22, a connector structure 10A according to a second embodiment of the present invention has a structure almost same as that of the connector structure 10 (see FIGS. 1 to 7) according to the aforementioned first embodiment. Hereafter, components shown in FIGS. 16 to 22 which are same as those of the first embodiment are referred by using reference signs same as those of the first embodiment.

As can be seen from comparison between FIGS. 16 to 22 and FIGS. 1 to 7, the connector structure 10A according to the present embodiment is different from the connector structure 10 of the first embodiment in a shape of a housing (holding member) 130A of a connector 100A and in a shape of a board 200A. More specifically, as shown in FIGS. 16 to 18, 20 and 22, the housing 130A has a rear portion 150A which has side surfaces 161A and 163A each of which is formed with one side recess 170A. Each of the side recesses 170A is a recess which has a rectangular shape when seen along the upper-lower direction. Each of the side recesses 170A is surrounded on its three sides by two vertical walls (protection portions) 171A, each of which extends in the upper-lower direction, and one lateral wall (additional protection portion) 173A extending in the front-rear direction. In other words, each of the side recesses 170A is formed by the two vertical walls 171A and the one lateral wall 173A of the housing 130A. Each of the side recesses 170A contains the first contact portions 127 of three of the contacts 120 positioned therein. Thus, three of the first contact portions 127 are positioned between the two vertical walls 171A of each of the side surfaces 161A and 163A.

Figure 16:
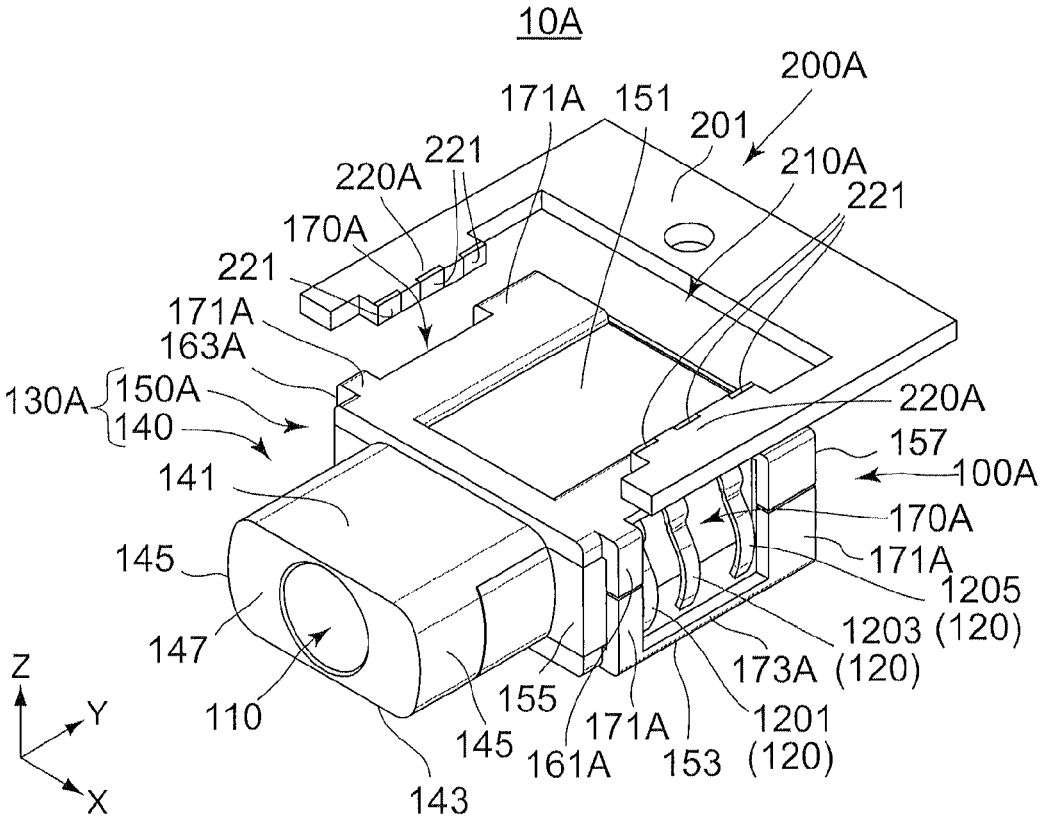
FIG. 16 is a perspective view showing a connector structure according to a second embodiment of the present invention, wherein a connector of the connector structure is not attached to a board of the connector structure.
Figure 17:
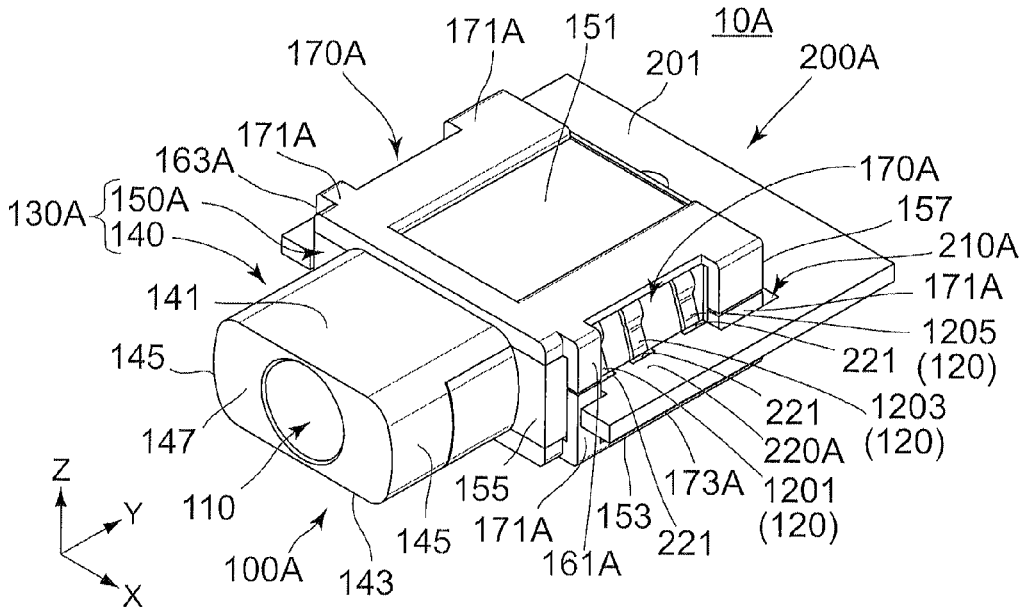
FIG. 17 is another perspective view showing the connector structure of FIG. 16, wherein the connector is attached to the board.
Figure 18:
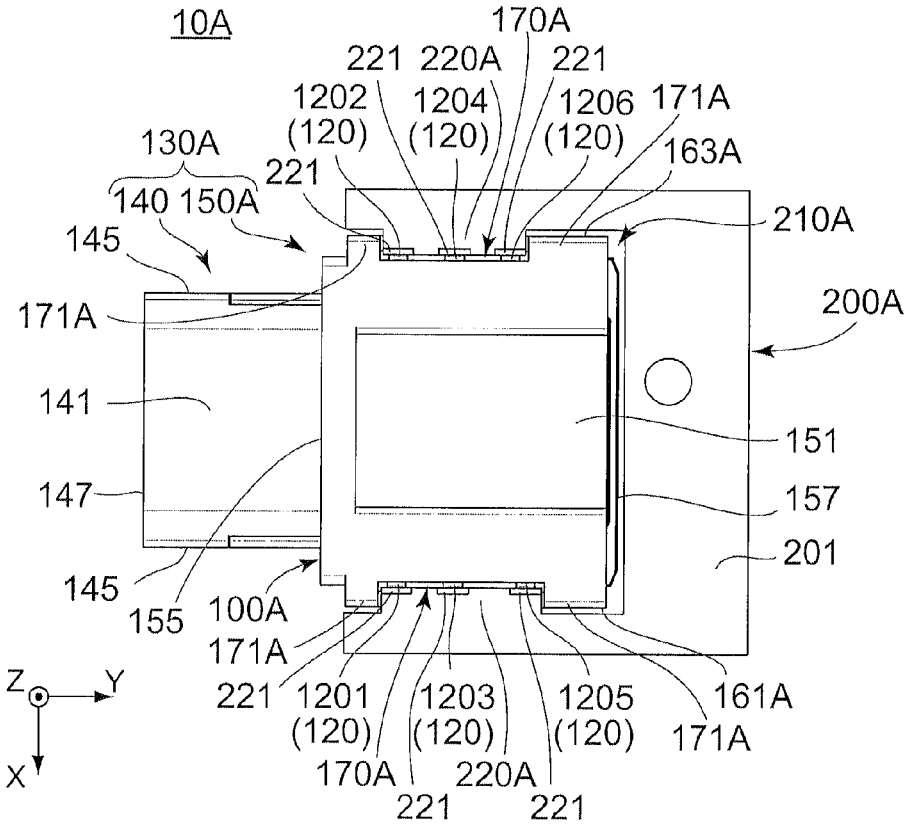
FIG. 18 is a plan view showing the connector structure of FIG. 17.
Figure 19:
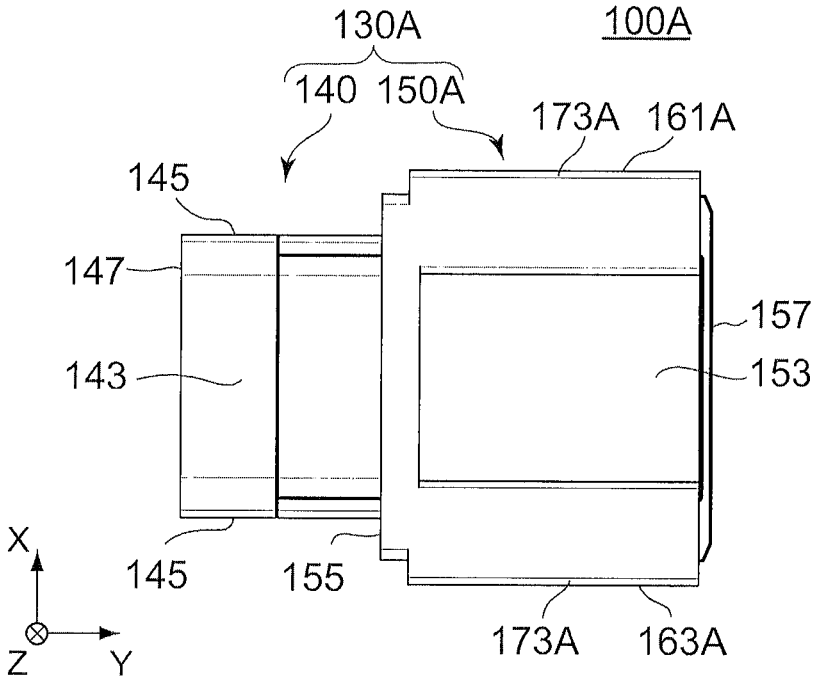
FIG. 19 is a bottom view showing the connector of the connector structure of FIG. 18.
Figure 20:
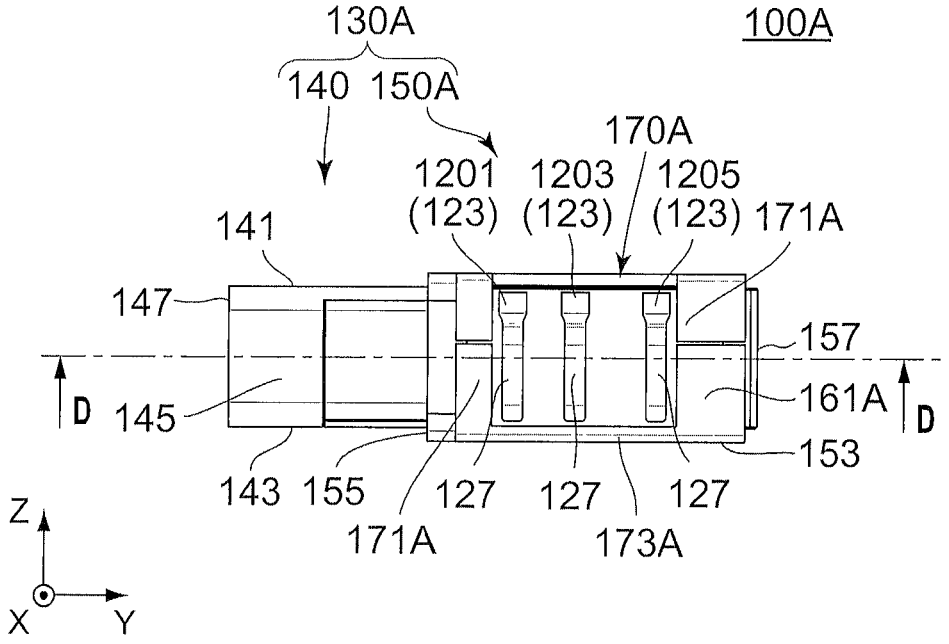
FIG. 20 is a right side view showing the connector of FIG. 19.

As shown in FIGS. 16 to 18, the board 200A has a recess 210A which accommodates, at least in part, the connector 100. In addition, the board 200A has a pair of projecting portions 220A each of which projects inward in the left-right direction within the recess 210A. The projecting portions 220A correspond to the side recesses 170A of the connector 100A, respectively. Each of the projecting portions 220A has a rectangular shape when seen along the upper-lower direction. Each of the projecting portions 220A has an end formed with a plurality of the board-side contact portions 221. The board-side contact portions 221 correspond to the contacts 120 of the connector 100A, respectively.

Figure 21:
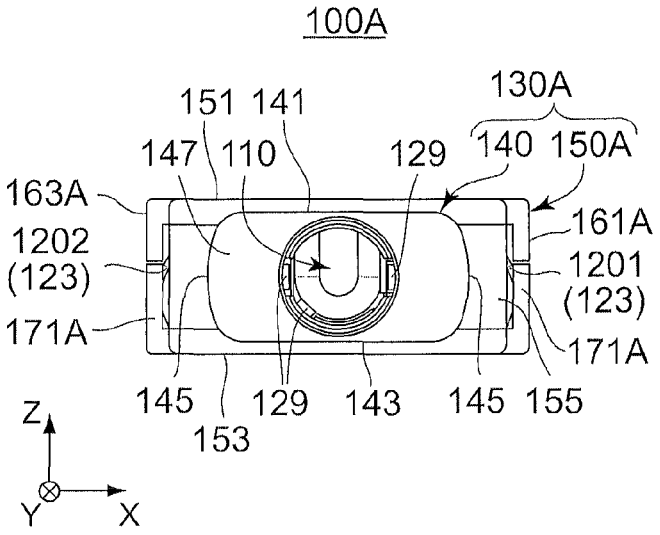
FIG. 21 is a front view showing the connector of FIG. 19.
Figure 22:
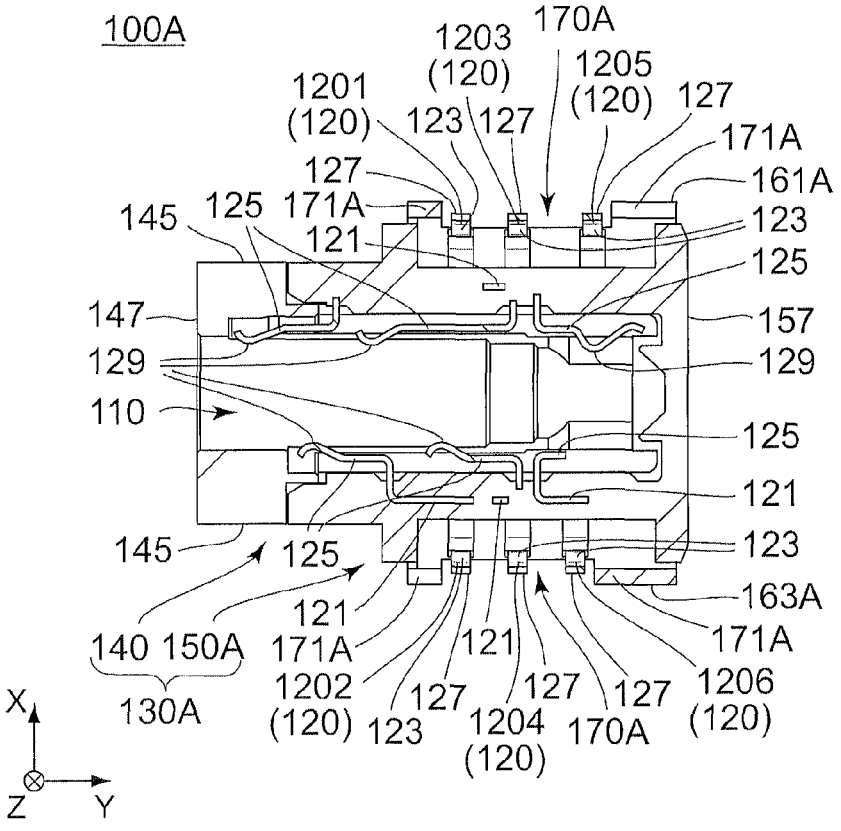
FIG. 22 is a cross-sectional view showing the connector of FIG. 20, taken along line D-D.

As can be seen from FIGS. 21 and 22, in the present embodiment, the vertical wall 171A hides the first contact portions 127 like the first embodiment when seen along the front-rear direction. Moreover, the vertical wall 171A hides, at least in part, the first support portions 123. In addition, as can be seen from FIG. 19, the lateral wall 173A hides the first contact portions 127 and the first support portions 123 when seen along the upper-lower direction. In other words, the first contact portion 127 of each of the contacts 120 is positioned within one of the side recesses 170A and does not project outward beyond the side surface 161A or 163A. At least a part of each of the vertical walls 171A works as the protection portion that protects the corresponding first contact portions 127, and at least a part of each of the lateral walls 173A works as the additional protection portion that protects the corresponding first contact portions 127. Therefore, in the present embodiment, each of the contacts 120 is prevented from being buckled or damaged like the first embodiment. Moreover, each of the lateral walls 173A is positioned opposite to the first support portions 123 across the first contact portions 127 and prevents the board 200A from being partially inserted into the side recess 170A. Therefore, the board 200A can be inserted into the side recesses 170A only from a predetermined side of the connector 100A, wherein the predetermined side is provided with the first support portions 123 with no lateral wall 173A. Thus, the lateral walls 173A prevent the ends of the contacts 120 from being brought into contact with the board-side contact portions 221. As a result, each of the contacts 120 is prevented from being buckled or damaged. As shown in FIG. 16, according to the present embodiment, when the contact 120 receives no load, a gap is formed between the end of the contact 120 and the lateral wall 173A. The contact 120 may be designed so that the gap between the contact 120 and the lateral wall 173A remains even when the contact 120 is resiliently deformed. Instead, the contact 120 may be designed so as to be brought into abutment with the lateral wall 173A when the contact 120 is resiliently deformed.

Third Embodiment

Figure 23:
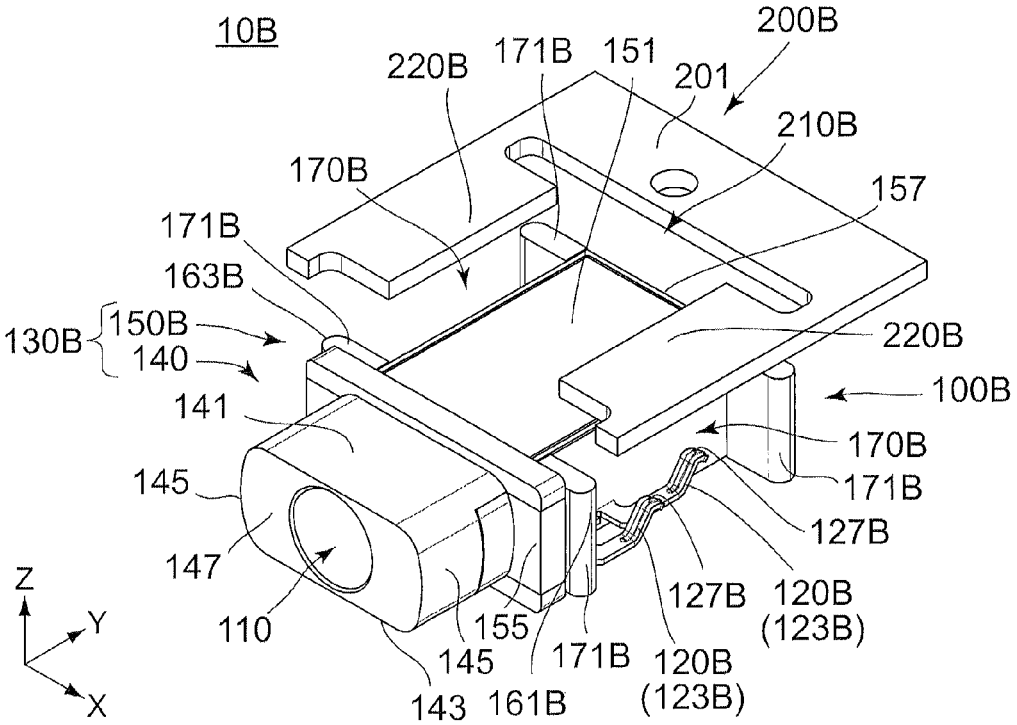
FIG. 23 is a perspective view showing a connector structure according to a third embodiment of the present invention, wherein a connector of the connector structure is not attached to a board of the connector structure.
Figure 24:
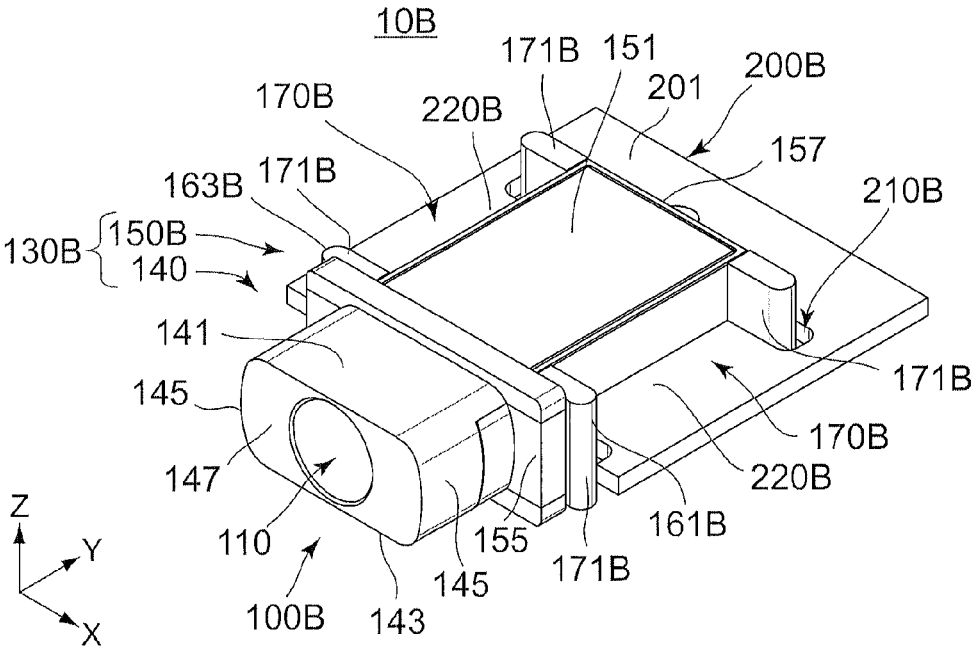
FIG. 24 is another perspective view showing the connector structure of FIG. 23, wherein the connector is attached to the board.
Figure 25:
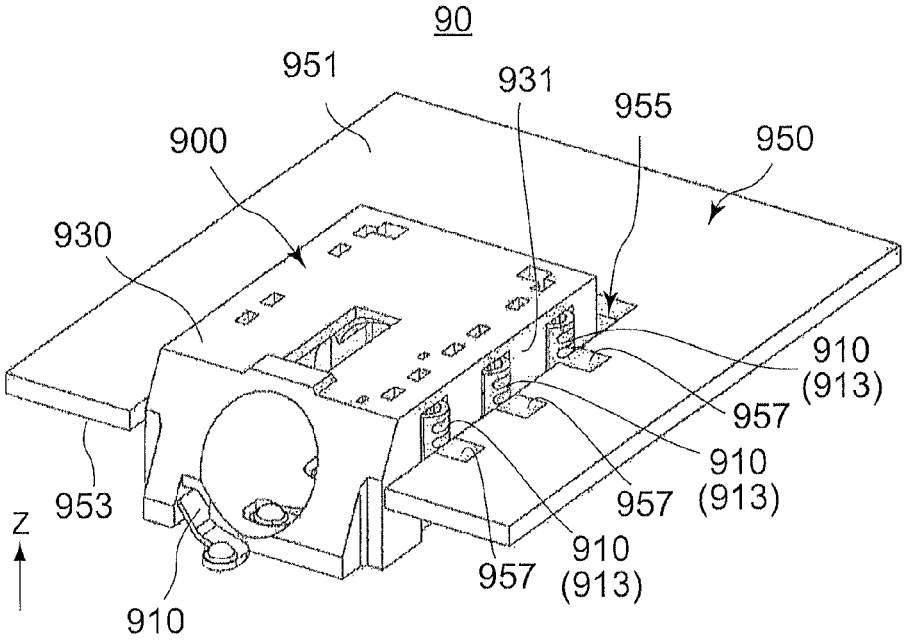
FIG.25 PRIOR ART
FIG. 25 is a perspective view showing a connector structure of Patent Document 1, wherein a connector of the connector structure is attached to a board of the connector structure.
Figure 26:
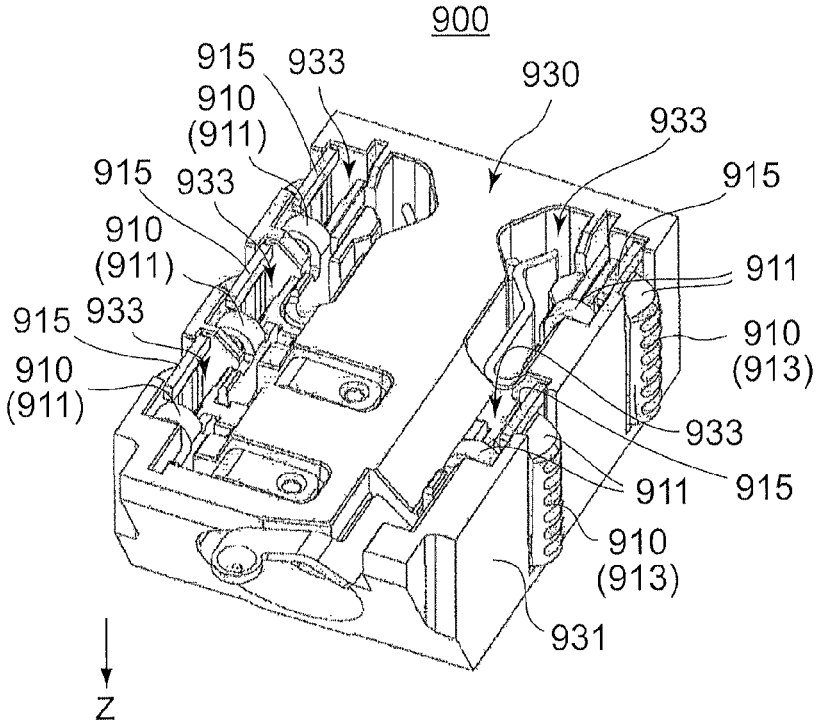
FIG.26 PRIOR ART
FIG. 26 is a bottom perspective view showing the connector of the connector structure of FIG. 25.

Referring to FIGS. 23 and 24, a connector structure 10B according to a third embodiment of the present invention has a structure almost same as that of the connector structure 10 (see FIGS. 1 and 2) according to the aforementioned first embodiment. Hereafter, components shown in FIGS. 23 and 24 which are same as those of the first embodiment are referred by using reference signs same as those of the first embodiment.

As shown in FIGS. 23 and 24, the connector structure 10B comprises a connector 100B and a board 200B. As shown in FIG. 23, the connector 100B has a plurality of contacts 120B and a housing (holding member) 130B which holds these contacts 120B. The contacts 120B have shapes different from one another. However, each of the contacts 120B has a held portion (not shown) held by the housing 130B, a first support portion (support portion) 123B extending from the held portion and a first contact portion (contact portion) 127B supported by the first support portion 123B. The first support portion 123B is resiliently deformable. The first contact portion 127B is movable at least in the upper-lower direction because of the resilient deformation of the first support portion 123B. When the first contact portions 127B of a plurality of the contacts 120B, which are positioned at a side surface 161B, are seen along the left-right direction, they are positioned at positions same as one another in the upper-lower direction and arranged in the front-rear direction. The aforementioned arrangement is also applied to the first contact portions (not shown) positioned at another side surface 163B.

As shown in FIGS. 23 and 24, the housing 130B has a rear portion 150B which has side recesses 170B each of which is formed at one of the side surfaces 161B and 163B. The housing 130B has vertical walls (protection portions) 171B which form the side recesses 170B. At the side surface 161B, the first support portions 123B and the first contact portions 127B are positioned between two of the vertical walls 171B. The aforementioned arrangement is also applied to the other side surface 163B. The vertical wall 171B hides the first contact portions 127B and the first support portions 123B when seen along the front-rear direction.

As shown in FIGS. 23 and 24, the board 200B has a recess 210B which accommodates, at least in part, the connector 100B. The board 200B has projecting portions 220B each of which projects inward in the left-right direction within the recess 210B. As can be seen from FIGS. 23 and 24, each of the projecting portions 220B has a lower surface which is formed with board-side contact portions (not shown). The board-side contact portions of the projecting portions 220B correspond to the first contact portions 127B of the contacts 120B, respectively. When the connector 100B is attached to the board 200B, each of the first contact portions 127B of the connector 100B is brought into contact and electrically connected with the corresponding board-side contact portion. In the present embodiment, each of the first contact portion 127B is brought into contact with the corresponding board-side contact portion in the upper-lower direction.

In the present embodiment, each of the vertical walls 171B works as the protection portion that protects the corresponding first contact portions 127B and the corresponding first support portions 123B. In the present embodiment, this protection prevents each of the contacts 120B from being buckled or damaged like the first embodiment and the second embodiment.

While the present invention has been described with specific embodiments, the present invention is not limited to the aforementioned embodiments but can be variously modified and changed. For example, although a plurality of the contacts 120 (120, 120B) are provided at each of the two side surfaces 161 and 163 (161A and 163A, 161B and 163B) of the housing 130 (130A, 130B) according to the aforementioned embodiments, the contacts 120 (120, 120B) may be provided at only one of the side surfaces 161 and 163 (one of 161A and 163A, one of 161B and 163B). In this case, the minimum number of the protection portions (vertical walls 171, 171A or 171B) may be two. Even in this case, the protection portions are arranged to be apart from each other in the front-rear direction, and the first contact portions 127 (127, 127B) of the contacts 120 (120, 120B) are arranged therebetween. In this case, the protection portion hides the first contact portions 127 (127, 127B) of the contacts 120 (120, 120B) when seen along the front-rear direction. Instead, the contacts 120 (120, 120B) may be provided at the rear surface 157 of the housing 130 (130A, 130B). In this case, the protection portions are arranged to be apart from one another in the left-right direction (first horizontal direction), and the first contact portions 127 (127, 127B) of the contacts 120 (120, 120B) are arranged therebetween. In this case, the protection portion hides the first contact portions 127 (127, 127B) of the contacts 120 (120, 120B) when seen along the left-right direction. Moreover, although the connector of each of the aforementioned embodiments has no fixing portion that fixes the connector to the board, the connector may be provided with a fixing portion that fixes the connector to the board.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector attachable to a board having a principal surface, a recess and a plurality of board-side contact portions, wherein:

when the connector is attached to the board, the connector is, at least in part, arranged within the recess while an upper-lower direction with respect to the connector intersects with the principal surface;

the connector comprises a plurality of contacts and a holding member which holds the contacts;

each contact has a held portion held by the holding member, a support portion extending from the held portion to be resiliently deformable and a contact portion supported by the support portion;

when the connector is attached to the board, each contact portion is brought into contact with a corresponding board-side contact portion;

the holding member has a plurality of protection portions protecting the contacts;

when the connector is attached to the board, each protection portion is, at least in part, positioned within the recess;

under a state where no load is applied to the contacts, the protection portions entirely hide the contact portions when seen along a first horizontal direction perpendicular to the upper-lower direction; and under a state where no load is applied to the contacts, the contact portions of all of the contacts are hidden and invisible when seen along the first horizontal direction.

2. The connector as recited in claim 1, wherein the protection portions hide the support portions and the contact portions when seen along the first horizontal direction.

3. The connector as recited in claim 1, wherein the protection portions are apart from one another in the first horizontal direction.

4. The connector as recited in claim 3, wherein:

the plurality of the contacts are positioned between the protection portions in the first horizontal direction.

5. The connector as recited in claim 1, wherein:

the holding member has an additional protection portion; and the additional protection portion hides the contact portion of each contact when seen along the upper-lower direction.

6. The connector as recited in claim 1, wherein each contact portion is brought into contact with the board-side contact portion in a direction which is perpendicular to the upper-lower direction and intersects with the first horizontal direction.

7. The connector as recited in claim 1, wherein each contact portion is brought into contact with the corresponding board-side contact portion in the upper-lower direction.

8. The connector as recited in claim 1, wherein:

the holding member has an accommodation portion which accommodates, at least in part, a mating connector having a mating contact portion;

each contact has an additional contact portion which projects in the accommodation portion; and the additional contact portion is brought into contact with the mating contact portion when the mating connector is accommodated in the accommodation portion.

9. The connector as recited in claim 1, wherein:

the holding member has a side surface and a side recess which is formed by walls and recessed inward from the side surface;

at least a part of the walls works as the protection portion; and the support portions and the contact portions are positioned within the side recess.

10. A connector structure comprising a connector and a board, wherein:

the connector is attachable to the board which has a principal surface, a recess and a plurality of board-side contact portions;

when the connector is attached to the board, the connector is, at least in part, arranged within the recess while an upper-lower direction with respect to the connector intersects with the principal surface;

the connector comprises a plurality of contacts and a holding member which holds the contacts;

each contact has a held portion held by the holding member, a support portion extending from the held portion to be resiliently deformable and a contact portion supported by the support portion;

when the connector is attached to the board, each contact portion is brought into contact with a corresponding board-side contact portion;

the holding member has a plurality of protection portions protecting the contacts;

when the connector is attached to the board, each protection portion is, at least in part, positioned within the recess;

under a state where no load is applied to the contacts, the protection portions entirely hide the contact portions when seen along a first horizontal direction perpendicular to the upper-lower direction; and under a state where no load is applied to the contacts, the contact portions of all of the contacts are hidden and invisible when seen along the first horizontal direction.

11. The connector structure as recited in claim 10, wherein:

the board has a projecting portion projecting within the recess in a direction which is perpendicular to the upper-lower direction and intersects with the first horizontal direction; and each board-side contact portion is formed on the projecting portion.

12. A connector attachable to a board having a principal surface, a recess and a board-side contact portion, wherein:

when the connector is attached to the board, the connector is, at least in part, arranged within the recess while an upper-lower direction with respect to the connector intersects with the principal surface;

the connector comprises at least one contact and a holding member which holds the contact;

the contact has a held portion held by the holding member, a support portion extending from the held portion to be resiliently deformable and a contact portion supported by the support portion;

when the connector is attached to the board, the contact portion is brought into contact with the board-side contact portion;

the holding member has at least one protection portion which protects the contact;

when the connector is attached to the board, the protection portion is, at least in part, positioned within the recess;

the protection portion hides the contact portion when seen along a first horizontal direction perpendicular to the upper-lower direction; and the contact portion is brought into contact with the board-side contact portion in a direction which is perpendicular to the upper-lower direction and intersects with the first horizontal direction.

13. A connector structure comprising a connector and a board, wherein:

the connector is attachable to the board which has a principal surface, a recess and a board-side contact portion;

when the connector is attached to the board, the connector is, at least in part, arranged within the recess while an upper-lower direction with respect to the connector intersects with the principal surface;

the connector comprises at least one contact and a holding member which holds the contact;

the contact has a held portion held by the holding member, a support portion extending from the held portion to be resiliently, deformable and a contact portion supported by the support portion;

when the connector is attached to the board, the contact portion is brought into contact with the board-side contact portion;

the holding member has at least one protection portion which protects the contact;

when the connector is attached to the board, the protection portion is, at least in part, positioned within the recess;

the protection portion hides the contact portion when seen along a first horizontal direction perpendicular to the upper-lower direction;

the board has a projecting portion projecting within the recess in a direction which is perpendicular to the upper-lower direction and intersects with the first horizontal direction; and the board-side contact portion is formed on the projecting portion.

* * * * *